United States Patent [19]

Theurer

[11] 4,224,874

[45] Sep. 30, 1980

[54] ALERT SYSTEM IN A MOBILE TRACK SURFACING MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 926,947

[22] Filed: Jul. 20, 1978

Related U.S. Application Data

[63] Continuation of Ser. No. 860,978, Dec. 15, 1977, abandoned, which is a continuation of Ser. No. 688,877, May 21, 1976, abandoned.

[30] Foreign Application Priority Data

Jun. 24, 1975 [AT] Austria ..... 4820/75

[51] Int. Cl.[2] ..... E01B 27/16

[52] U.S. Cl. ..... 104/12; 33/1 Q; 104/7 R; 116/62.1; 246/191

[58] Field of Search ..... 104/7 R, 7 A, 7 B, 12, 104/2, 8; 33/1 Q, 338, 144, 146; 340/32; 246/122 R, 174, 182 B, 191; 116/28 R, 62.1, 202; 73/499; 235/95 A, 96, 97

[56] References Cited

U.S. PATENT DOCUMENTS

| | | | |
|---|---|---|---|
| Re. 27,604 | 3/1973 | Stewart et al. | 104/12 |
| 290,767 | 12/1883 | Gillespie | 116/62.1 X |
| 1,422,349 | 7/1922 | Eigabroadt | 246/191 X |
| 3,314,373 | 4/1967 | Plasser et al. | 104/7 R X |
| 3,380,394 | 4/1968 | Fornerod | 104/7 B |
| 3,401,642 | 9/1968 | Fisher | 104/12 X |
| 3,423,858 | 1/1969 | Speno | 104/7 R X |
| 3,550,076 | 12/1970 | Kent | 116/62.1 X |
| 3,744,428 | 7/1973 | Plasser et al. | 104/7 R X |
| 3,762,333 | 10/1973 | Theurer et al. | 104/12 |
| 3,856,195 | 12/1974 | Kakizaki et al. | 235/97 |
| 4,094,250 | 6/1978 | Theurer | 104/12 |

*Primary Examiner*—Randolph A. Reese
*Attorney, Agent, or Firm*—Kurt Kelman

[57] ABSTRACT

An alert system in a mobile track surfacing machine arranged for intermittent advancement by selected distances from one tamping station to a succeeding tamping station and comprising an operator's station including a control panel for enabling the operator to operate the machine, which alert system comprises an odometer or tie counter for defining the selected distance, a signaling instrument arranged for generating an alert signal for ready preception by the operator to indicate to the operator the succeeding tamping station during the advancement of the machine, and a control for the signaling instrument for generating the readily preceptible alert signal in response to the selected distance whereby the alert signal readily perceptibly indicates to the operator the succeeding tamping station as the advancing machine approaches the succeeding tamping station.

7 Claims, 4 Drawing Figures

ALERT SYSTEM IN A MOBILE TRACK SURFACING MACHINE

This is a continuation of my copending application Ser. No. 860,978, filed Dec. 15, 1977, now abandoned, which was a continuation of Ser. No. 688,877, filed May 21, 1976, now abandoned.

The present invention relates to an apparatus and method of alerting an operator to an approach to a succeeding tamping station in a mobile track surfacing machine arranged for intermittent advancement by selected distances along the track from one tamping station to a succeeding tamping station.

Mobile track surfacing machines carrying one or more track tie tamping units each having tamping tool means immersible in respective ones of the cribs at a respective one of the tamping stations and an operator's station including a control panel for enabling the operator to operate the machine are known and many machines of this type have automatic control means for controlling the intermittent advancements of the machine as well as an odometer or tie counter defining the selected distance of advancement from tamping station to tamping station.

In conventional track surfacing operations, the track position is corrected, i.e. the track is lined and/or leveled, and the ballast under the successive track ties is tamped to fix the track in the corrected position as the mobile machine intermittently advances about three or ten feet from tamping station to tamping station over a track section which may extend for miles. In modern track surfacing machines, a single operator at a control panel may operate all machine functions, i.e. he controls the machine drive, including the power supply, motor temperature, oil pressure and the like, the complex instrumentation surveying and determining the track alignment and/or leveling and/or superelevation to obtain the desired corrected track position, transitions from tangent to curved track and vice versa, including possible adjustments of the reference system for determination of the corrected track position, and the tamping, including hydraulic and/or pneumatic pressures in the conduits leading to various lining, leveling and tamping tools. In addition, the operator must watch out to maintain safe operation of the machine, including observation of traffic or adjacent tracks with which his operations could possibly interfere, for instance in case of excessive lateral track movements during alignment. All of these observations and controls must be carried out by the operator continuously and often simultaneously as the machine advances intermittently over miles of track. This clearly requires extreme concentration on the part of the operator who must not be unnecessarily diverted from his main tasks.

One of the functions of the machine the operator must control is the accurate and timely centering of the tamping tools in relation to the cribs in which the tools are to be immersed for tamping the ballast under adjacent ties to avoid damage to the ties, which is particularly difficult when the tamping unit is adapted for the simultaneous tamping of several track ties, whether the machine carries several spaced apart tamping units or a single unit comprising an arrangement of tamping tools capable of simultaneously tamping a plurality of ties, or even two tampers coupled for operation in tandem. These operating difficulties increase in proportion to the sometimes non-uniform distances of advancement between tamping stations to cover two, three or even four ties since the rapidly advancing track surfacing operation sometimes makes it difficult to distinguish between tamped ties and those ties which have not yet been tamped. In this connection, it must also be noted that the operating cab from which the operator controls the work of the machine usually is not located immediately above the tamping units but is spaced therefrom in the direction of track elongation. This forces the operator to view the tamping operation under an oblique angle, making it even more difficult to ascertain which ties have to be tamped and to center the tamping tools.

Track tamping machines with automatic controls for the intermittent advancement of the machine from tamping station to tamping station are known. In U.S. reissue patent No. Re. 27,604, such a control is triggered by colored marks on the rails whose spacing is controlled by the measured tie spacings. The mobile track working machine of U.S. Pat. No. 3,762,333, dated Oct. 2, 1973, carries a switch preceding the tamping head and, upon contact with a rail fastening element, a distance measurement is initiated. Depending on the distance between tamping head and switch, this distance measurement is used for accurate centering of the tamping tools over a tie to be tamped. This machine has been very successful for the fully automatic control of the machine advancement, tamping, lining and leveling in single cycle. However, this type of automatic control is useful only for sections of a track, such as straight track sections or track sections in which the tie spacings do not greatly differ and/or the ties do not extend obliquely to the track axis. Where such conditions are encountered, manual control becomes necessary.

Whether the tamping head position must be manually controlled or not, track surfacing operations over long stretches of track require, in practice, that such positioning be always under the observation of the operator to make certain that no damage be done to the ties by the immersing tamping tools. On the other hand, the operator is so preoccupied by the various control functions he must handle that he must not be diverted by this observation until, and for the moment, it requires his attention. At this moment, it is desirable to remove his attention from all other control functions and to concentrate it on this single observation and, if required, control of the tamping head position.

It is the primary object of the invention to provide an alert signal readily perceptible by the operator of an intermittently advancing track surfacing machine to alert the operator to an approach to the tamping station as the machine advances thereto, the readily perceptible alert signal being such that it will divert his attention to the tamping and preferably changing or intensifying in proportion to the proximity to the tamping station. In this manner, if required, the alerted operator may manually control the advancement of the machine and/or the positioning of the tamping head and the operator is enabled with a large measure of certainty and in sufficient time to locate the ties and/or cribs to be tamped.

The above and other objects are accomplished in accordance with this invention with an alert system in a mobile track surfacing machine of the indicated type which alerts the operator to an approach to the succeeding tamping section as the machine advances thereto and which comprises a means for defining the selected distance from one tamping station to the succeeding tamping station, a signal means for generating an alert signal for ready perception by the operator to indicate to the operator the succeeding tamping station during the advancement of the machine, and means for controlling the signal means for generating the readily perceptible alert signal. The controlling means operatively connects the distance defining means and the signal means for producing the alert signal in response to the selected distance defined by the distance defining means whereby the alert signal readily perceptibly indicates to the operator the succeeding tamping station as the advancing machine approaches the succeeding tamping station.

The alert signal may be a relatively small colored marker of the size of the order of about two to three ballast pieces in a respective one of the cribs and, preferably, it is a light or acoustic signal of increasing intensity as the machine approaches the tamping station.

The method of alerting the operator according to the present invention comprises the steps of defining each selected distance, generating a control signal in response to each of the selected distances, and generating an alert signal readily perceptible by the operator in response to the control signal. The position of the tamping unit may be controlled with respect to the succeeding tamping station by the operator under the guidance of the alert signal.

The readily perceptible alert signal is generated only for the moments when the machine approahces the tamping station and, at that time, it momentarily diverts the operator's attention from his manifold operating tasks to alert him the task at hand by the type of signal that cannot be ignored by him and is automatically generated as the machine advances to enable the operator to observe at the required time the actual location of the tamper or, at the end of the advancement, to sight with accuracy the tie or cribs to be tamped so that he may accurately immerse the tamping tools for the tamping operation. This provides a speedier operation and helps to assure that no tie is tamped twice or not at all, which assures a more uniform tamping over a long track section. In addition, the operator of a mobile track tamping machine incorporating the alert system of the present invention, particularly an automatically controlled machine with a plurality of tamping heads, is thus alerted without untimely distraction to correct false control signals emanating from the automatic machine advancement control. Furthermore, the operator of a machine alerted by the readily perceptible alert signals of this invention is freed of the necessity of concentrating on the centering of the tamping tools while attending to his multitudinous operating tasks, which has been required in the prior art machines. This enables the operator to concentrate on the control of the leveling and lining operation instead of having to observe the centering of up to 16 or even 32 tampering tools for immersion in the ballast.

The above and other objects, advantages and features of the present invention will become more apparent from the following detailed description of now preferred embodiments thereof, taken in conjunction with the accompanying schematic drawing wherein FIG. 1 is a side elevational view of a mobile track tamping, leveling and lining machine incorporating an optical and acoustic signaling arrangement according to this invention;

Figures 1, 2, 3, 4:
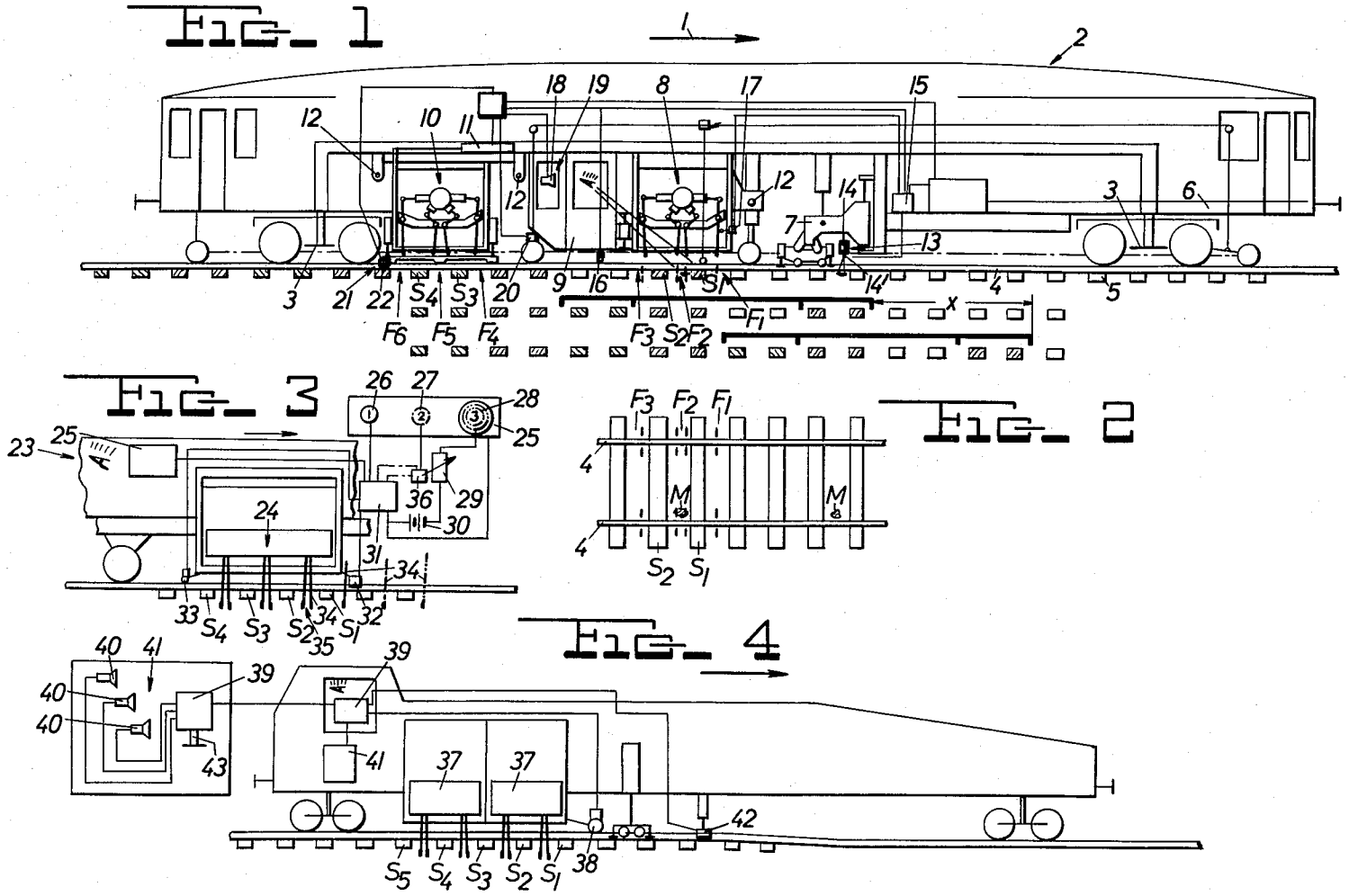
FIG. 2 is a top view of the track in the region of the track tamping tools and colored markings.
FIG. 3 is a schematic circuit diagram of an optical signaling arrangement with lamps.
FIG. 4 is a schematic circuit diagram of an acoustic signaling arrangement.

Referring now to the drawing and first to FIG. 1, a mobile track surfacing machine constituted by tamping, leveling and lining machine 2 is arranged for intermittent advancement in the direction of arrow 1 by selected distances x along a track including a plurality of successive ties 5 defining cribs therebetween and rails 4 fastened to the ties, the machine having a frame 6 mounted on undercarriages 3, 3 for movement on the track rails. The machine frame carries a combined track lifting and lining unit 7, a forward tamping unit or head 8 having two pairs of reciprocatory tamping tools for simultaneously tamping two ties, a rear tamping head 10 of substantially the same design, and an operator' station constituted by operating cab 9 intermediate the two tamping heads. The tamping heads are mounted on transverse guide beams 12 for movement of the tamping heads transverse of the track so that the tamping tools may be properly centered over the track rails even in tight curves. Furthermore, transverse guide beam 12 on which rear tamping head 10 is mounted is also movable in the direction of the track and a drive 11 enables this tamping head to be moved in this direction for adjustment along the track elongation. All of these structures are conventional.

Two signaling arrangements according to this invention are mounted on the machine for the accurate and timely indication of ties $S_1$, $S_2$ and associated cribs $F_1$, $F_2$, $F_3$ to be tamped, i.e. for perceptibly signaling each tamping station and alerting an operator in cab 9 to the approach thereto. Signal means 13 is mounted in the region of track lifting and lining unit 7. This signal means is associated with tamping head 8 and precedes the same in the operating direction of the machine, the illustrated signal means including dye spraying nozzle device 14 to produce colored alert marker M. This nozzle is operated by control means 15 to produce the marker in the crib of a respective one of the tamping stations, the control means being operatively connected to odometer 16 which defines a distance along the track which the machine has traversed. The control circuit includes limit switch 17 which is tripped by the lowering of tamping head 8 to close the control circuit and operate the spraying device, for instance by supplying compressed air thereto to spray the dye and produce a colored marker M, as shown in FIG. 2.

In the illustrated embodiment, marker signal M is produced in the crib wherein the two center tamping tools of the pair of reciprocatory tamping tools are to be immersed in the succeeding tamping operation so that the operator will be enabled to sight this crib readily for centering tamping head 8 thereover. Nozzle 14' of dye spraying device 14 is mounted close to the surface of the ballast and is arranged to mark a relatively small area of the order of about two or three ballast pieces so that, when the tamping tools are reciprocated during the tamping operation, the marker is obliterated and does not divert the operator during subsequent surfacing work.

In the illustrated embodiment, signal means 13 is spaced from the center tamping tools of tamping head 8 by a distance corresponding to the average distance x of advancement of machine 2 from tamping station to tamping station. In this case, it is sufficient if the dye spraying or marking operation is initiated by the closing of switch 17 on lowering of the tamping head. However, it is also possible to mount signal means 13 at any suitable location preceding the tamping head in the direction of advancement of the machine, in which case the signal means control 15 is operated in response to odometer 16 or any other means defining the distance which the machine has traveled.

Such a dye marker arrangement very simply alerts the operator to the proper crib over which he has to center the tamper head in each tamping operation as the machine intermittently advances along the track and "erases" the signal after it has served its purpose to avoid distraction in succeeding operations and eliminate any false information during subsequent track work.

Acoustic signal generating means 19 is arranged in operating cab 9 to enable the operator to control the positioning of rear tamping unit 10. The illustrated signal means includes loudspeaker 18 but it could be a buzzer, a bell, a horn or any other suitable device producing an audible signal. Signal means 19 is operated by odometer 20 associated with tamping head 10 or by counter 21 for counting the number of ties within selected distance x. This counter is mounted in the region of the rear tamping heads and, in the illustrated embodiment, includes signal pulse generator 22, such as described fully in U.S. Pat. No. 3,762,333. The signal means may be arranged to generate a short audible signal each time the signal pulse generator 22 passes over a tie, the successive signals indicating the number of ties passed, or it may generate a continuously more intensive sound giving the operator an acoustic impression about the centering of tamping head 10.

How and if acoustic and optical signal generating means are combined on a machine, what specific acoustic and/or optical signals are generated, and whether the signals are generated successively or continuously will depend on the specific type of track surfacing machine in use, the location of the operating cab on the machine, the number of tamping heads to be supervised, the operating noise of the machine and other factors.

Track tamping, leveling and lining machine 2 is preferably provided with a generally conventional automatic control for the advancement of the machine from tamping station to tamping station, centering of forward tamping unit 8 being monitored by optical signal means 13 for fine adjustment of the machine position at the tamping station while drive 11 for centering rear tamping unit 10 is automatically controlled in response to an acoustic signal from signal means 19 which requires no observation.

FIG. 3 schematically illustrates another embodiment of a signal means for generating an alert signal constituted by a coupled digital and analog indication. The illustrated track tamping, leveling and lining machine 23 comprises tamping head 24 with three pairs of spreading tamping tools for the simultaneous tamping of four adjacent ties $S_1$, $S_2$, $S_3$, $S_4$. A machine with this type of tamping unit advances by a distance of three ties from tamping station to tamping station. The operator of the machine receives a progressively changing light alert signal at signal means 25 to make readily visible to him the distance of the machine advancement as the machine moves from station to station. The signal means has ben illustrated on an enlarged scale outside of the machine. As shown, signal means 25 comprises a plurality, i.e. three, optical signal indicating elements connected in series, each element including an electric lamp. Lamps 26 and 27 produce a digital information, lamp 26 showing the number 1 and lamp 27 the number 2 to indicate to the operator that the first tie is passed when lamp 26 lights up and the second tie is passed when lamp 27 lights up. Third lamp 28 is connected to electric voltage source 30 through adjustable resistance 29. The lamps are connected to the voltage source by control 31 which is operatively connected to tie counter 32 and odometer 33. This alert signaling means operates as follows:

After tamping at the illustrated tamping station has been completed, the tamping head has been raised and advancement of machine 23 towards the next tamping station has been initiated, counter 32 will operate control 31 to light up lamp 26 when the foremost tamping tool 34 of the foremost tamping tool pair 35 has passed the first tie, thus signaling to the operator that the first untamped tie has been passed. As tamping tool 34 reaches the position indicated in chain-dotted lines, lamp 27 will light up to signal to the operator that two untamped ties have been passed. As tamping tool 34 moves from the position shown in chain-dotted lines to the position indicated in broken lines, tie counter 32 will operate motor 36 of voltage regulator 29 to light up lamp 28 with an increased intensity, i.e. the light intensity of lamp 28 will increase analog to the passing of the third tie to alert the operator to the completion of the advancement to the next tamping station. Thus, the lighted lamps will guide the operator continuously and the more intense light signal at the end will enable him readily to monitor braking of the machine at the next tamping station and immersion of the tamping head at that station.

Obviously, the optical signals may be responsive to the position of any tamping tool of unit 24 so that the operator may adapt signal means 25 to the tamping tool he uses as a guide for centering the entire unit.

During daylight, a more intense voltage may be supplied to the lamps to increase the intensity of the light for better visibility. Increasing the intensity of the last alert signal at the end of the machine advancement will aid the operator in controlling the machine operations according to the rhythm established by the succession of signals. This increases the speed of the operational control and this is further enhanced since the alert signaling means is arranged in the operator's cab within view of the operator on the control panel, or the cab is glass-enclosed so that any colored marker on the ballast may be readily viewed from the cab. If the colored markers are arranged in the range of the tamping tools to be centered over the tamping station, as shown in FIG. 2, proper centering will be greatly facilitated since the operator will observe the marker concurrently with the immersion of the tamping tools in the ballast without diversion, thus avoiding damage to the ties by the lowered tamping tools. This is of particular advantage when the operator manually controls the advancement of the machine since, in this case, minimum diversion in the control of the tamping tool immersion is essential.

FIG. 4 schematically illustrates an acoustic signal generator 41 for signaling to the operator the distance traveled by the machine. The illustrated track tamping leveling and lining machine carries two tamping heads 37, 37 each carrying two pairs of spreading tamping tools for the simultaneous tamping of a plurality of ties, this machine necessitating a forward movement by a distance of four ties from tamping station to tamping station. This distance is measured by odometer 38 connected operatively to control 39 in the operator's cabin for actuating signal means 41. The illustrated signal means shown in an enlarged view outside the machine comprises a series of three loudspeakers 40. As illustrated by the increasing sizes of the three loudspeakers, the intensity of the audible signals generated by the loudspeakers increase proportionally to the distance traversed by the machine, as measured by odometer 38 which operates the loudspeaker control 39. This increase in sound intensity may be continuous or stepwise so as to guide the monitoring of the controls by the operator. The control circuit from odometer 38 to control 39 is closed, i.e. the control is operated by the odometer, by activation of signal pulse generator 42 which is positioned on the machine frame in relation to tamped ties $S_1$ to $S_5$ so that it is located in the crib between the third and fourth tie forwardly of foremost tie $S_1$ being tamped. This provides a fixed distance x between the tamping units and pulse generator 42, which distance is measured by odometer 38 to regulate the intensity of sound produced by loudspeakers 40 as the machine advances to the next tamping station. The regulation of the sound intensity is important since mixed noise frequencies emanate from the machine during operation thereof. Regulator 43 makes it possible to produce acoustic signals through loudspeakers 40 whose frequencies differ from the mixed noise frequencies enamating from the machine. In this manner, the operator will be able to distinguish the signals from the normal operating noise.

The various embodiments of optical and/or acoustic signaling means may be combined on any machine in any suitable manner, particularly on tamping, leveling and lining machines carrying a plurality of tamping heads spaced in the direction of track elongation, as shown by way of example in FIGS. 1 and 4, or a single tamping head with several pairs of tamping tools spaced in such direction, as shown in FIG. 3. Also, if the machine operation is to be monitored by more than one man, the signal means may be mounted not only in the operator's station but also in the range of the tamping heads and/or at a suitable location on the machine frame to enable a man walking next to the machine to observe its advancement and, guided thereby, to aid in the control of the machine operations.

What is claimed is:

1. In a mobile track surfacing machine arranged for intermittent advancement by selected distances along the track from one tamping station to a succeeding tamping station, the track including a plurality of successive ties arranged on ballast and defining cribs therebetween, and the machine carrying a track tie tamping unit having tamping tool means immersible in respective ones of the cribs at a respective one of the tamping stations and an operator's station arranged within view of the tamping unit, the operator's station including a control panel for enabling the operator to operate the machine: apparatus for alerting the operator to an approach to the succeeding tamping station as the machine advances thereto, and for enabling the operator to center the tamping tool means between the successive ties at the succeeding tamping station, the apparatus comprising the combination of (a) a means for defining the selected distances, (b) a spraying nozzle mounted on the machine close to the surface of the ballast and arranged to produce a relatively small colored marker of a size of the order of about two to three ballast pieces in a respective one of the cribs, (c) a signal means at the operator's station within view of the operator for generating a progressively changing light alert signal visibly indicating to the operator an approach to the succeeding tamping station during the advancement of the machine and including a final signal indicating the succeeding tamping station, and (d) means for controlling the spraying nozzle for producing successive ones of the colored markers and for controlling the signal means for generating the progressively changing alert light signal, (1) the controlling means operatively connecting the distance defining means, the spraying nozzle and the signal means in response to a selected distance defined by the means for defining the selected distances whereby the progressively changing alert signal visibly indicates to the operator the approach to the succeeding tamping station as the advancing machine approaches the succeeding tamping station, the final signal indicates to the operator the arrival at the succeeding tamping station and the colored marker enables the operator to center the tamping tool means.

2. In the mobile track surfacing machine of claim 1, the signal means comprising a plurality of electric lamps connected in series, successive ones of the lamps lighting up as the machine advances towards the succeeding tamping station.

3. In the mobile track surfacing machine of claim 2, an electric voltage source connected to deliver current to the lamps, and a voltage regulator arranged between the voltage source and at least one of the lamps, the voltage regulator being adjustable in response to the advance of the machine to increase the light intensity of the lamp in direction proportion to the advance.

4. In a mobile track surfacing machine arranged for intermittent advancement by selected distances along the track from one tamping station to a succeeding tamping station, the track including a plurality of successive ties arranged on ballast and defining cribs therebetween, and the machine carrying a track tie tamping unit having tamping tool means immersible in respective ones of the cribs at a respective one of the tamping stations and an operator's station arranged within view of the tamping unit, the operator's station including a control panel for enabling the operator to operate the machine: apparatus for alerting the operator to an approach to the succeeding tamping station as the machine advances thereto, and for enabling the operator to center the tamping tool means between the successive ties at the succeeding tamping station, the apparatus comprising the combination of (a) a means for defining the selected distances, (b) a spraying nozzle mounted on the machine close to the surface of the ballast and arranged to produce a relatively small colored marker of a size of the order of about two to three ballast pieces in a respective one of the cribs, (c) a signal means at the operator's station within view of the operator for generating a progressively changing acoustic alert signal audibly indicating to the operator an approach to the succeeding tamping station during the advancement of the machine and including a final signal indicating the succeeding tamping station, and (d) means for controlling the spraying nozzle for producing successive ones of the colored markers and for controlling the signal means for generating the progressively changing acoustic alert signal, (1) the controlling means operatively connecting the distance defining means, the spraying nozzle and the signal means in response to a selected distance defined by the means for defining the selected distances whereby the progressively changing alert signal audibly indicates to the operator the approach to the succeeding tamping station as the advancing machine approaches the succeeding tamping station, the final signal indicates to the operator the arrival at the succeeding tamping station and the colored marker enables the operator to center the tamping tool means.

5. In the mobile track surfacing machine of claim 4, the signal means being arranged to produce a succession of different acoustic alert signals as the machine approaches the succeeding tamping station.

6. In the mobile track surfacing machine of claim 4, the signal means being arranged to produce a continuous acoustic alert signal of progressively increasing intensity as the machine approaches the succeeding tamping station.

7. A method of alerting an operator of a mobile track surfacing machine arranged for intermittent advancement by selected distances along the track from one tamping station to a succeeding tamping station, the track including a plurality of successive ties arranged on ballast and defining cribs therebetween, and the machine carrying a track tie tamping unit having tamping tool means immersible in respective ones of the cribs at a respective one of the tamping stations and an operator's station including a control panel for enabling the operator to operate the machine, which comprises the steps of (a) defining each one of the selected distances from the tamping tools means to the succeeding tamping station adjacent the succeeding tamping station, (b) generating a control signal in response to each of the selected distances, (c) generating a progressively changing alert signal including a final signal readily perceptible by the operator in response to the control signal whereby the operator is alerted to an approach to the succeeding tamping station as the advancing machine approaches the succeeding tamping station and the arrival at the succeeding tamping station at the final signal, (d) applying a colored marker in a respective one of the cribs in response to the control signal; and (e) controlling the position of the tamping unit in the succeeding tamping station under the guidance of the colored marker in the respective crib to center the tamping tool means between the successive ties at the succeeding tamping station.

* * * * *